US010619532B2

(12) United States Patent
Jachmann

(10) Patent No.: US 10,619,532 B2
(45) Date of Patent: Apr. 14, 2020

(54) LUBRICATING DEVICE AND INTERNAL COMBUSTION ENGINE COMPRISING SUCH A LUBRICATING DEVICE

(71) Applicant: ikra GmbH, Muenster-Altheim (DE)

(72) Inventor: Horst Jachmann, Hoesbach (DE)

(73) Assignee: ikra GmbH, Muenster-Altheim (DE)

( * ) Notice: Subject to any disclaimer, the term of this patent is extended or adjusted under 35 U.S.C. 154(b) by 0 days.

(21) Appl. No.: 16/055,741

(22) Filed: Aug. 6, 2018

(65) Prior Publication Data

US 2019/0063278 A1 Feb. 28, 2019

(30) Foreign Application Priority Data

Aug. 31, 2017 (DE) ..... 10 2017 120 109

(51) Int. Cl.

*F01M 11/02* (2006.01)
*F01M 11/00* (2006.01)
*F02B 63/02* (2006.01)

(52) U.S. Cl.

CPC ..... *F01M 11/02* (2013.01); *F01M 11/0004* (2013.01); *F01M 2011/0066* (2013.01); *F01M 2011/0083* (2013.01); *F01M 2011/0087* (2013.01); *F01M 2011/026* (2013.01); *F02B 63/02* (2013.01)

(58) Field of Classification Search

CPC ..... F02B 63/02; F01M 9/06; F01M 11/065; F01M 11/0004; F01M 1/06

See application file for complete search history.

(56) References Cited

U.S. PATENT DOCUMENTS 4,896,634 A * 1/1990 Kronich ..... F01M 1/02 123/196 W
5,447,127 A 9/1995 Lück et al.
6,152,098 A * 11/2000 Becker ..... F01L 1/02 123/196 M
6,213,079 B1 * 4/2001 Watanabe ..... F01M 1/04 123/196 R (Continued)

FOREIGN PATENT DOCUMENTS

EP 0631040 B1 3/1998

*Primary Examiner* — Long T Tran
(74) *Attorney, Agent, or Firm* — Bond Schoeneck & King, PLLC; George McGuire

(57) ABSTRACT

A lubricating device for lubricating an internal combustion engine irrespective of orientation, which device comprises a housing that forms a housing part of the internal combustion engine, is, in order to make it possible to reliably lubricate an internal combustion engine, irrespective of orientation, by means of simple constructive means, designed and developed such that a first working chamber for storing lubricant and a second working chamber that is separate from the first working chamber are arranged in the housing, such that a passage is formed from the first working chamber to the second working chamber, such that the second working chamber comprises an opening to a crankshaft receiving area of the housing, and such that the first working chamber comprises a lubricant channel to the crankshaft receiving area, the opening and the lubricant channel being spaced apart from each other in a height direction such that lubricant can be supplied to the crankshaft receiving area, irrespective of orientation, at least via the opening or the lubricant channel.

10 Claims, 9 Drawing Sheets

(56) References Cited

U.S. PATENT DOCUMENTS

| | | | | |
|---|---|---|---|---|
| 6,679,692 | B1 * | 1/2004 | Feuling | F04C 2/102<br>418/171 |
| 6,786,188 | B1 * | 9/2004 | Kawamoto | F01M 1/12<br>123/196 R |
| 2001/0035148 | A1 * | 11/2001 | Ito | F01M 1/04<br>123/196 R |
| 2001/0047788 | A1 * | 12/2001 | Ito | F01M 1/04<br>123/196 R |
| 2017/0276038 | A1 * | 9/2017 | Mukohara | B01D 29/03 |

* cited by examiner

C-C

A–A

D-D

LUBRICATING DEVICE AND INTERNAL COMBUSTION ENGINE COMPRISING SUCH A LUBRICATING DEVICE

CROSS-REFERENCE TO RELATED APPLICATIONS

This application relates and claims priority to German Application No. DE 10 2017 120 109.2, filed Aug. 31, 2017, the entire disclosure of which is incorporated herein by reference.

BACKGROUND OF THE INVENTION

The present invention relates to a lubricating device for lubricating an internal combustion engine irrespective of orientation, the device comprising a housing that forms a housing part of the internal combustion engine.

Lubricating devices of the abovementioned kind are known from the prior art, e.g. from EP 0 631 040 B1, in which lubrication takes place by means of a fuel-oil mixture. U.S. Pat. No. 6,213,079 B1 also discloses a lubricating device in which oil is sucked in at the free end by means of a flexible hose provided with a weight.

However, the disadvantage of the known lubricating devices is that they have a complex, heavy design or deliberately burn oil during operation. Adequate lubrication of the internal combustion engine with comparatively low exhaust gas emissions is not always ensured.

The object of the invention is to make it possible to reliably lubricate an internal combustion engine, irrespective of its orientation, by means of simple constructive means. It is desirable to implement circulating lubrication.

SUMMARY OF THE INVENTION

The invention achieves the above-mentioned object by means of a lubricating device having the features of claim 1. The lubricating device is characterized in that a first working chamber for storing lubricant and a second working chamber that is separated from the first working chamber by means of a, preferably peripheral, wall are arranged in the housing, that a passage from the first working chamber to the second working chamber is formed in the wall, preferably arranged above a lubricant fill level, that the second working chamber comprises an opening (first suction point) to a crankshaft receiving region or crankshaft receiving area of the housing, and that the first working chamber comprises a lubricant channel (second suction point) to the crankshaft receiving area, wherein the opening and the lubricant channel are spaced apart from each other in a height direction (in parallel with the running direction of the piston of the internal combustion engine) such that lubricant can be supplied to the crankshaft receiving area, irrespective of orientation, at least via the opening or the lubricant channel.

In other words, the opening forms a first suction point and the lubricant channel forms a second suction point (free end of the lubricant channel). The two suction points are positioned in the height direction such that irrespective of orientation, i.e. in any operating orientation of the lubricating device or of the internal combustion engine, at least one of the two suction points can convey lubricant or lubricant mist.

A design of this kind allows adequate lubrication irrespective of orientation, as lubricant or lubricant mist can be conveyed to lubrication points of the internal combustion engine. Lubricant or lubricant mist can therefore be conveyed from the first working chamber (lubricant reservoir or "oil sump") into the second working chamber via the passage and supplied to a crankshaft receiving area from the second working chamber via the opening, e.g. in order to feed a crankshaft lubricant hole or a bearing point of the crankshaft. A first flow path from the first working chamber into the crankshaft receiving area is therefore produced, along which flow path lubricant is conveyed. Lubricant can also be supplied to the crankshaft receiving area from the first working chamber via the lubricant channel, e.g. to a crankcase for receiving crank webs. This creates a second flow path from the first working chamber into the crankshaft receiving area.

Lubricant or lubricant mist can be conveyed, due to the pressure differences produced by the piston movement, between the crankshaft receiving area and the first and second working chambers, e.g. due to the resulting negative pressure when the piston of the internal combustion engine moves from bottom dead center (UT) to top dead center (OT). The passage is positioned such that lubricant or lubricant mist can pass into the second working chamber from the first working chamber irrespective of orientation, i.e. irrespective of the position/orientation of the internal combustion engine with regard to the direction of gravity.

The housing of the lubricating device forms a housing part of the internal combustion engine, namely in particular a lower engine part. The lower engine part is arranged on the side of the crankshaft facing away from the cylinder and the piston. The other engine housing part may be referred to as an upper engine part. The upper engine part may comprise a cylinder having pistons, valves and a valve control means arranged therein. The upper engine part and the separate lower engine part rest on top of one another at a crankcase parting plane and can be separated from one another. The crankcase parting plane separates the crankshaft receiving area in the height direction (in parallel with the running direction of the piston), in particular in the center. Engine oil having an appropriate viscosity may be used as lubricant.

The passage may in particular be arranged such that it is above a fill level of the lubricant when the internal combustion engine is in a normal position (the housing and lower engine part face downwards in the direction of gravity). In particular, the passage may be centered with regard to the wall (wall height and wall width). The wall may in particular be peripheral, such that the second working chamber is surrounded by the second working chamber and is therefore inside the second working chamber, but is separated therefrom by the wall.

The opening may be arranged on the upper (as viewed in the height direction) region, in particular on the upper end, of the second working chamber. The lubricant channel may in particular be designed such that the free end thereof is below a lubricant fill level. The lubricant channel may be designed as a solid channel that is attached to or molded on a wall that separates the second working chamber from the crankshaft receiving region, in particular the crankcase wall. A defined position of the suction point is specified by a fixed lubricant channel. Alternatively, the lubricant channel may be designed as a flexible suction tube oer hose that is fastened to a wall separating the second working chamber from the crankshaft receiving region, in particular the crankcase wall, and extends into the second working chamber. An enlarged suction region is produced by the flexible suction tube, as the free end of the suction tube or hose, which may optionally be provided with a balance weight, is oriented under the influence of gravity.

According to a preferred embodiment, return channels from the crankshaft receiving area into the first working chamber may be provided, such that lubricant can be conveyed back from the crankshaft receiving area into the first working chamber through the return channels. In this way, collected or condensed lubricant can be conveyed back from the crankshaft receiving area into the first working chamber by means of the return channels. The lubricant can therefore be stored in a first working chamber and then be supplied again to the crankshaft receiving area. The lubricating device therefore implements circulating lubrication. The return channels may each be designed as a hole or a self-acting valve (membrane valve). Preferably, the return channels as a whole (together) may have a cross-sectional area (total hydraulic area) that is between 25% and 95% of the cross-sectional area of the opening and of the lubricant channel (common total area of the opening and the lubricant channel). This achieves a restricting effect and ensures that an adequate amount of lubricant is in the crankcase and in the crankshaft receiving area.

Advantageously, a spinning means for spinning lubricant may be provided in the first working chamber. Specifically, a spinner wheel (whirl wheel) may be arranged in the first working chamber, which spinner wheel is coupled, in particular in a rotationally fixed manner, to a toothed wheel that is arranged in the second working chamber and extends towards the opening. The toothed wheel is designed to mesh with a toothed wheel arranged on the crankshaft, as a result of which the toothed wheel and the spinner wheel can be driven. Lubricant is swirled by the spinner, so that lubricant mist is produced that can reach the second working chamber through the passage from the first working chamber. The lubricant mist can be supplied to the crankshaft receiving area in a particularly simple manner, in particular due to the pressure differences produced by the piston movement. The toothed wheel is arranged axially at the opening to the crankshaft receiving area. A recess may adjoin the opening, which recess is aligned with a crankshaft lubricant hole when the crankshaft is in specific rotational positions.

Expediently, the spinner wheel and the toothed wheel may be connected by means of a shaft portion that projects through the passage. A direct and stable connection between the spinner wheel and the toothed wheel is therefore implemented. A combined spinner wheel and toothed wheel unit is produced. The remaining cross section of the passage is therefore annular. A bearing passage is provided into which a bearing pin can be inserted, such that the spinner wheel and the toothed wheel can be mounted, in particular on bearing portions of the first housing portion. The spinner wheel, the toothed wheel and the shaft portion are preferably integrally formed. This promotes stability and makes production and assembly easier.

In the context of a preferred embodiment, a crankcase wall may be provided that separates a crankcase (crank chamber) for receiving crank webs of the crankshaft, in which case the crankcase forms a portion of the crankshaft receiving area, from a portion of the first working chamber. Due to the separation of the crankcase from the first working chamber, lubricant remains at least for the most part in the first working chamber, namely irrespective of the position of the internal combustion engine (retention irrespective of position).

Advantageously, the lubricant channel can extend, starting from the first working chamber, in particular from below a lubricant fill level, through the crankcase wall and open into the crankcase (crank chamber). As a result, lubricant can be sucked from the first working chamber and supplied to the crankcase due to the pressure differences produced by the piston movement. The lubricant channel opens in particular into a curved portion of the crankcase wall, past which portion the crank webs of the crankshaft travel. As a result, a kind of rotary valve can be implemented, the mouth of the lubricant channel on the crankcase side being temporarily opened and temporarily restricted or closed by the crank webs. Preferably, the lubricant channel is arranged such that the mouth of the lubricant channel is closed by the crank web when the piston moves from top dead center (OT) to bottom dead center (UT). The lubricant channel may therefore be open at least temporarily (lubricant is drawn into the crankcase) when the piston moves from UT to OT ("upwards"). When the piston moves from OT to UT ("downwards"), the lubricant channel may be at least temporarily closed (lubricant being pushed back through the lubricant channel due to overpressure produced by the piston movement is at least reduced).

Specifically, the return channels may be formed in the crankcase wall in order to return condensed lubricant from the crankcase into the first working chamber. This makes it easy for the lubricant to be returned, it being possible to convey lubricant through the return channels due to the effect of gravity and/or due to the overpressure in the crankcase produced by the downward movement of the piston. The return channels may be arranged in a portion of the crankcase (collecting region) that is lower with regard to the height direction (in parallel with the direction of movement of the piston). The lower portion of the crankcase may be designed as a flat portion. The return channels may, as mentioned above, be designed as holes in the crankcase wall. Four return channels may be provided. Alternatively, the return channels may, as already mentioned, each be controlled, i.e. opened and closed, by a self-acting or automatically-acting valve (membrane valve). The valves may be arranged in particular on or in the crankcase wall.

In the context of a preferred embodiment, the housing may comprise a first (upper) housing portion that faces the crankshaft receiving area. In addition, the housing may comprise a separate second (lower) housing portion that faces away from the crankshaft receiving area. The design of the housing having a plurality of housing portions makes it easier to produce, assemble and maintain the lubricating device and the internal combustion engine overall.

Advantageously, the first housing portion and the second housing portion may rest on top of one another or on each other at a first (outer) parting plane when assembled, the first parting plane and a crankcase parting plane that is in particular in parallel with the longitudinal axis of the crankshaft receiving area forming or including an angle. This design makes it easier to assemble the spinner wheel and the toothed wheel, i.a. because it is easier to insert the bearing pin. In addition, this design creates space for flexibly arranging an oil measuring stick hole and an oil measuring stick. In other words, the crankcase parting plane and the first parting plane are not mutually parallel. In particular, the crankcase parting plane and the first parting plane form an angle of 15° to 45°, preferably of 15° to 25°, more preferably from 15° to 20°, even more preferably of 18°. As already mentioned, the crankcase parting plane separates the crankshaft receiving area in the height direction (in parallel with the running direction of the piston), in particular in the center. The housing (lower engine part) and the upper engine part rest on top of one another or on each other at the crankcase parting plane when assembled.

Expediently, the first housing portion and the second housing portion may rest at a second (inner) parting plane when assembled, the second parting plane and a crankcase parting plane that is in parallel with the longitudinal axis of the crankshaft receiving area being mutually parallel. This makes it easier to assemble and maintain the spinner wheel and the toothed wheel.

The object mentioned above is also solved by an internal combustion engine, in particular for a hand-held working tool or gardening tool, comprising a lubricating device of this kind. The internal combustion engine is in particular a four-stroke engine. The four-stroke engine is used in particular as a drive source for a hand-held working tool or gardening tool, e.g. a chainsaw, hedge shears, a leaf blower or the like. With regard to the advantages, reference is made to the embodiments of the lubricating device. The measures described in conjunction with the lubricating device can be used to further design the internal combustion engine.

BRIEF DESCRIPTION OF THE DRAWINGS

The invention will be explained in more detail in the following with reference to the drawings, same or functionally similar elements being provided only once with reference signs if necessary. In the drawings.

DETAILED DESCRIPTION

Figure 1:
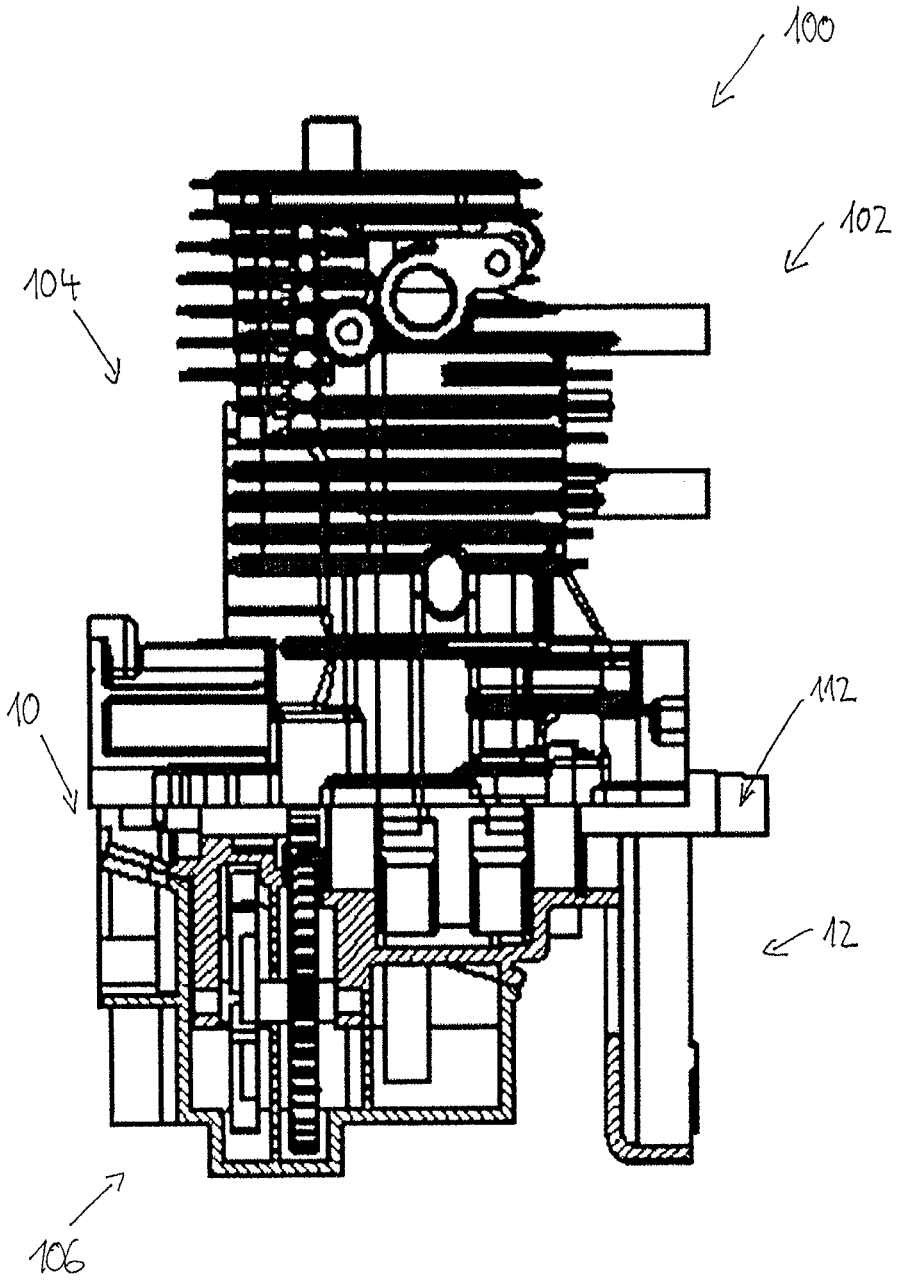
FIG. 1 is a partially cut side view of an embodiment of the lubricating device and of the internal combustion engine.

FIG. 1 shows an internal combustion engine 100 for a hand-held working tool or gardening tool, which internal combustion engine comprises a lubricating device 10 that is described further in the following.

The internal combustion engine 100 is a four-stroke engine comprising an engine housing 102 that comprises an upper housing part 104 and a lower housing part 106. The internal combustion engine 100 also comprises a cylinder that is in the upper housing part 104, comprises a piston operating therein and is connected to a crankshaft 112 via a connecting rod (components shown only in part).

FIG. 1 also shows a lubricating device for lubricating an internal combustion engine 100 irrespective of orientation, which device is denoted overall by the reference sign 10. The lubricating device 10 comprises a housing 12 that forms a housing part 106 (lower housing part) of the internal combustion engine 100.

Figure 2:
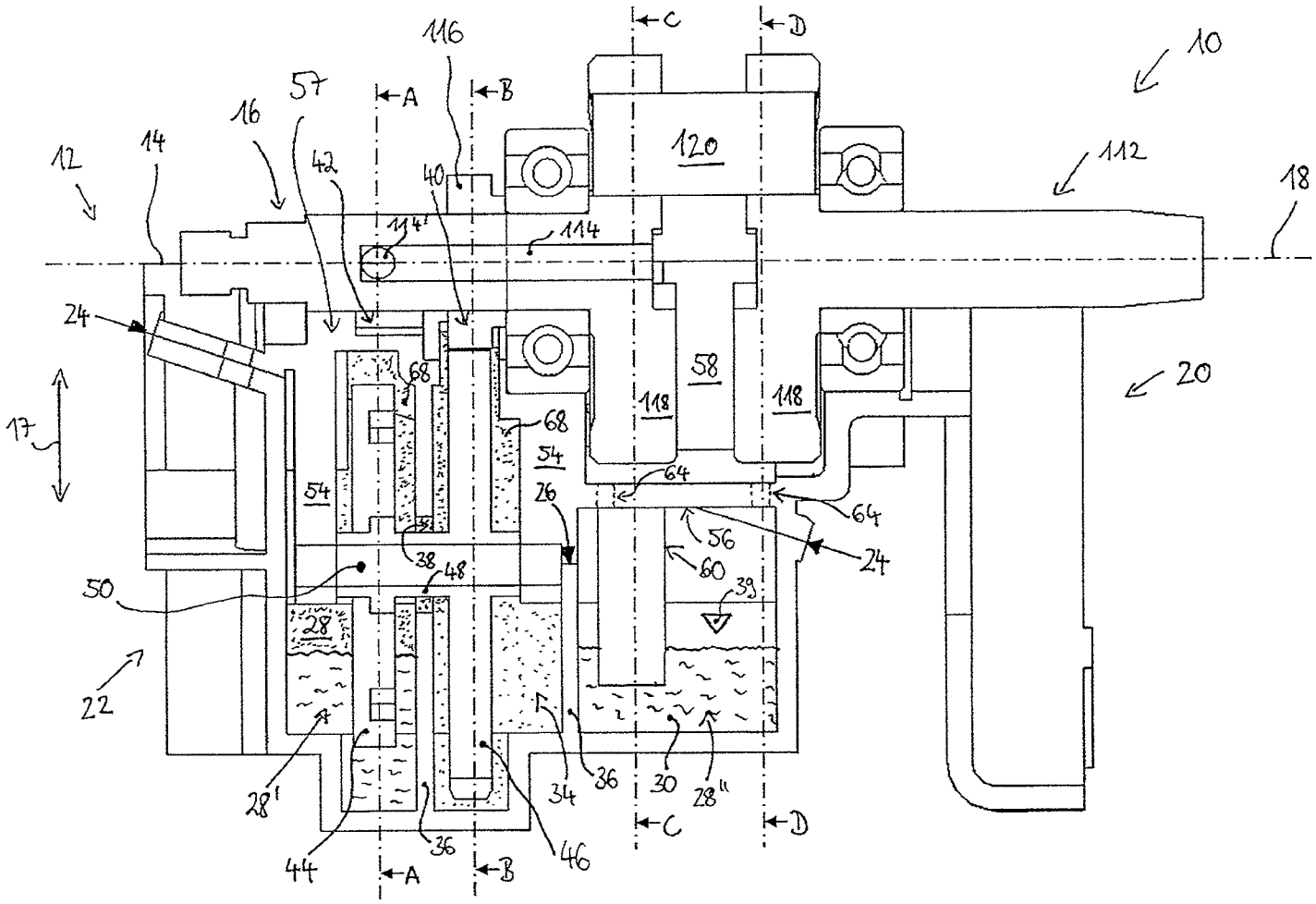
FIG. 2 is a longitudinal section through the lubricating device from FIG. 1.

The housing 12 is shown in more detail in a longitudinal section in FIG. 2, the crankshaft 112 also being shown. The housing 12 comprises a crankcase parting plane 14 on the upper face thereof, at which parting plane the housing 12, which forms a lower housing part 106 of the internal combustion engine 100, and the upper housing part 104 rest on top of one another when assembled. The housing 12 and the upper housing part 104 define, when assembled, a crankshaft receiving region or a crankshaft receiving area 16 for receiving the crankshaft 112. The crankshaft receiving area 16 has a longitudinal axis 18, which corresponds to the longitudinal axis of the crankshaft 112 when the crankshaft 112 is inserted. The crankcase parting plane 14 centrally separates the crankshaft receiving area 16 in the height direction 17.

Figure 4:
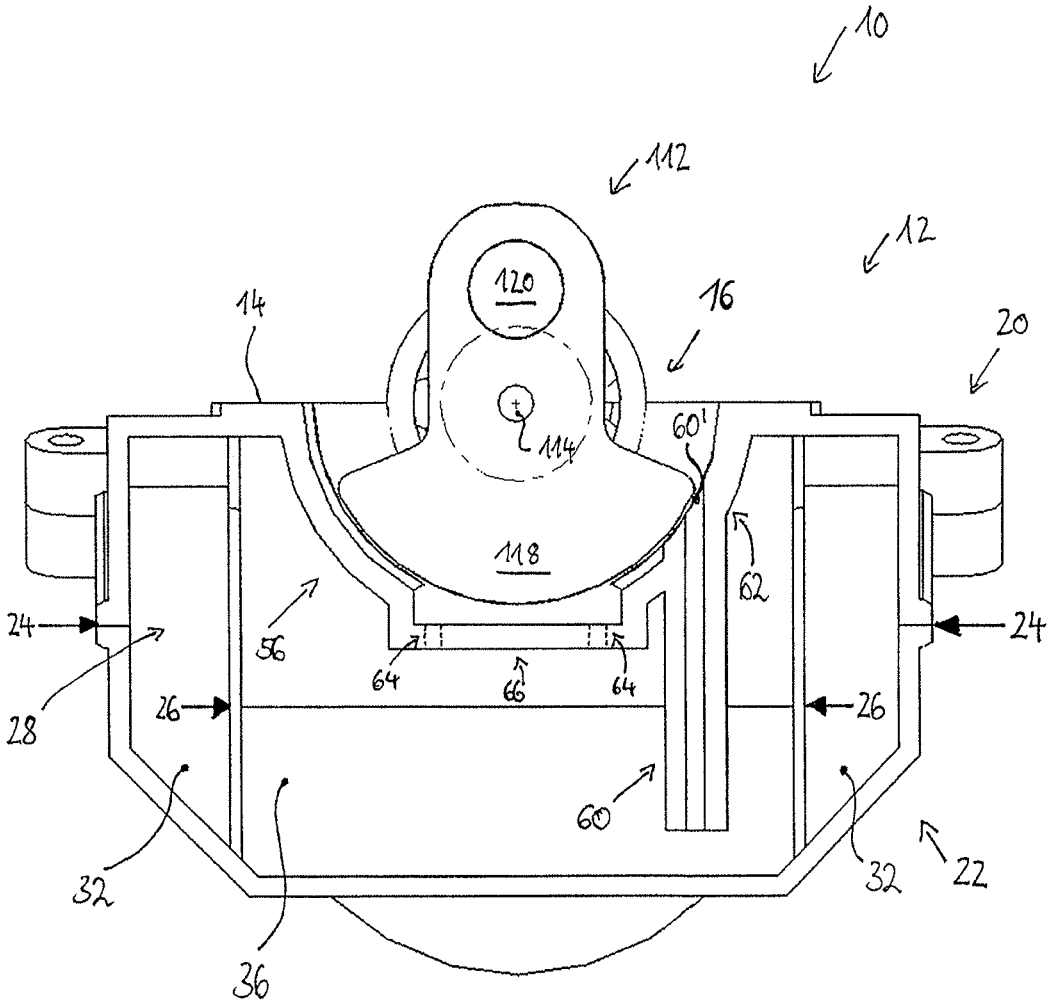
FIG. 4 is a section through a second portion of the first working chamber, together with the crankshaft, along a section line C-C shown in FIG. 2.

The housing 12 comprises a first (upper) housing portion 20 and a second (lower) housing portion 22. The first housing portion 20 and the second housing portion 22 rest on top of one another at a first (outer) parting plane 24. The first parting plane 24 and the crankcase parting plane 14 together form an angle, for example an angle of 18°. In addition, the first housing portion 20 and the second housing portion 22 rest on top of one another at a second (inner) parting plane 26 (see FIG. 2, FIG. 4 and FIG. 8). The second parting plane 26 and the crankcase parting plane 14 are mutually parallel.

Figure 3:
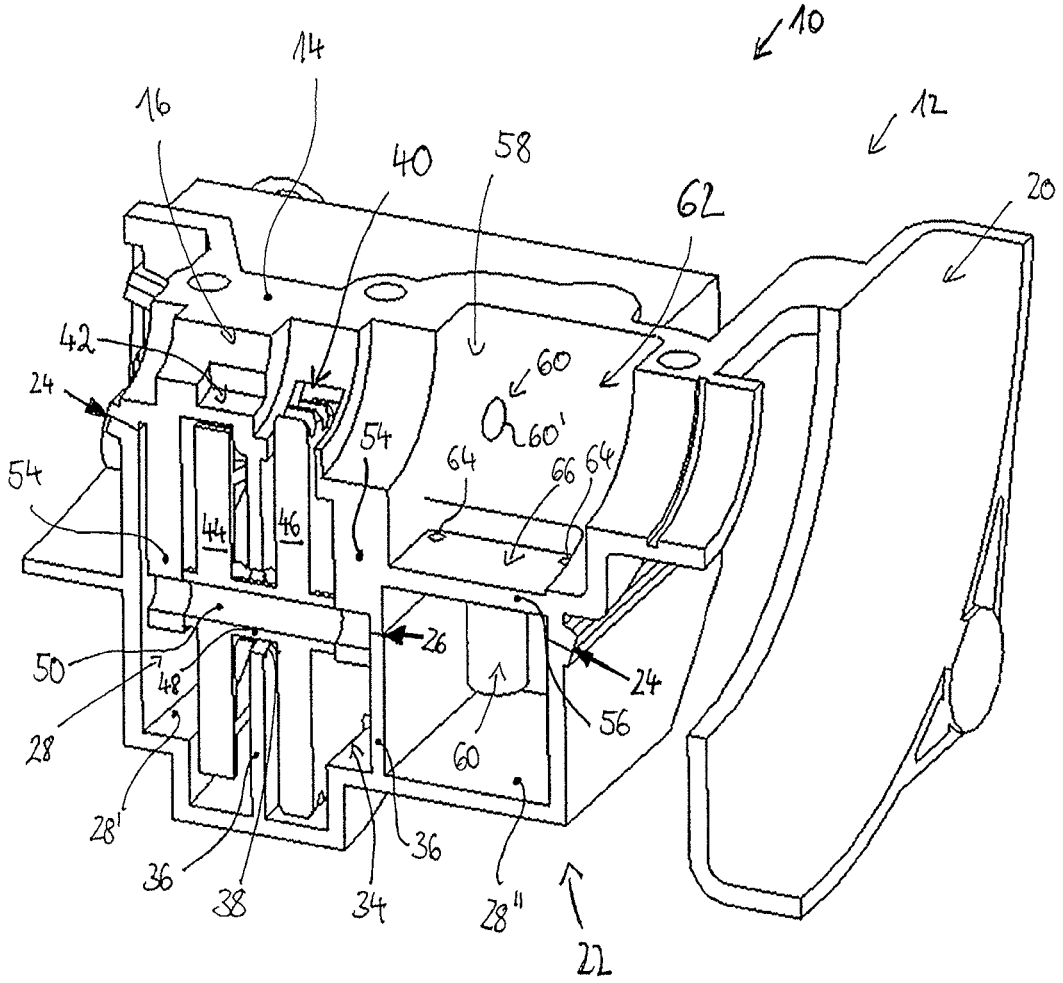
FIG. 3 is a perspective partial section of the lubricating device from FIG. 1.
Figure 8:
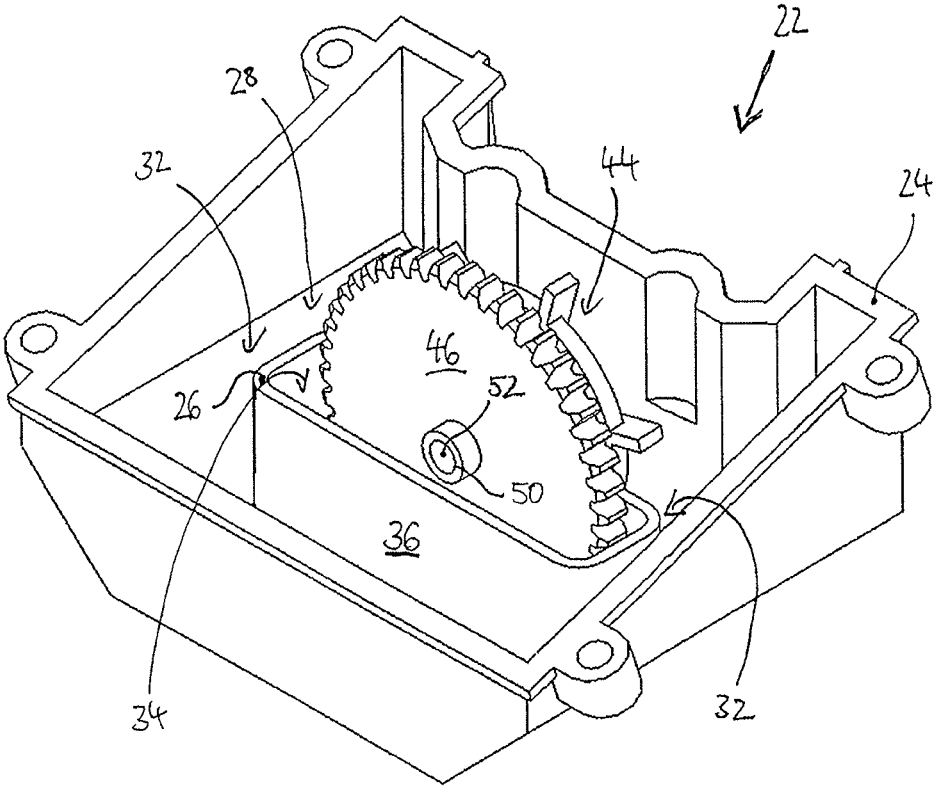
FIG. 8 shows a second (lower) portion of the housing of the lubricating device from FIG. 1 with the spinner wheel and toothed wheel inserted.

A first working chamber 28 is arranged in the housing 12, which working chamber is used to store lubricant 30 (see FIG. 2). The first working chamber 28 comprises a first portion 28' and a second portion 28" that are in fluid connection with one another by means of connecting portions 32 (see FIG. 4 and FIG. 8). A second working chamber 34 is also arranged in the housing 12, which working chamber is separated from the first working chamber 28 by means of a peripheral wall 36 (see i.a. FIG. 2, FIG. 3 and FIG. 8).

A passage 38 from the first working chamber 28 to the second working chamber 34 is formed in the wall 36. The passage 38 is arranged above a lubricant fill level 39 (see FIG. 2). The second working chamber 34 comprises an opening 40 to the crankshaft receiving area 16 of the housing 12 (see FIG. 2 and FIG. 3). A recess 42 adjoins the opening 40. When the crankshaft 112 is in a specific rotational position, this recess is aligned with a crankshaft lubricant hole 114 that is formed in the crankshaft 112. The opening 40 forms a first suction point.

A spinning means for spinning lubricant 30 is provided in the first working chamber 28. Specifically, a spinner wheel 44 is arranged in the first working chamber 28. A toothed wheel 46 is arranged in the second working chamber 34, which toothed wheel is connected to the spinner wheel 44, which projects through the passage 38, for rotation therewith, namely by means of the shaft portion 48. The passage 38 has a circular cross section, the shaft portion 48 that is circular in cross section projecting through the passage 38. The remaining cross section in the passage 38 is therefore annular.

Figure 5:
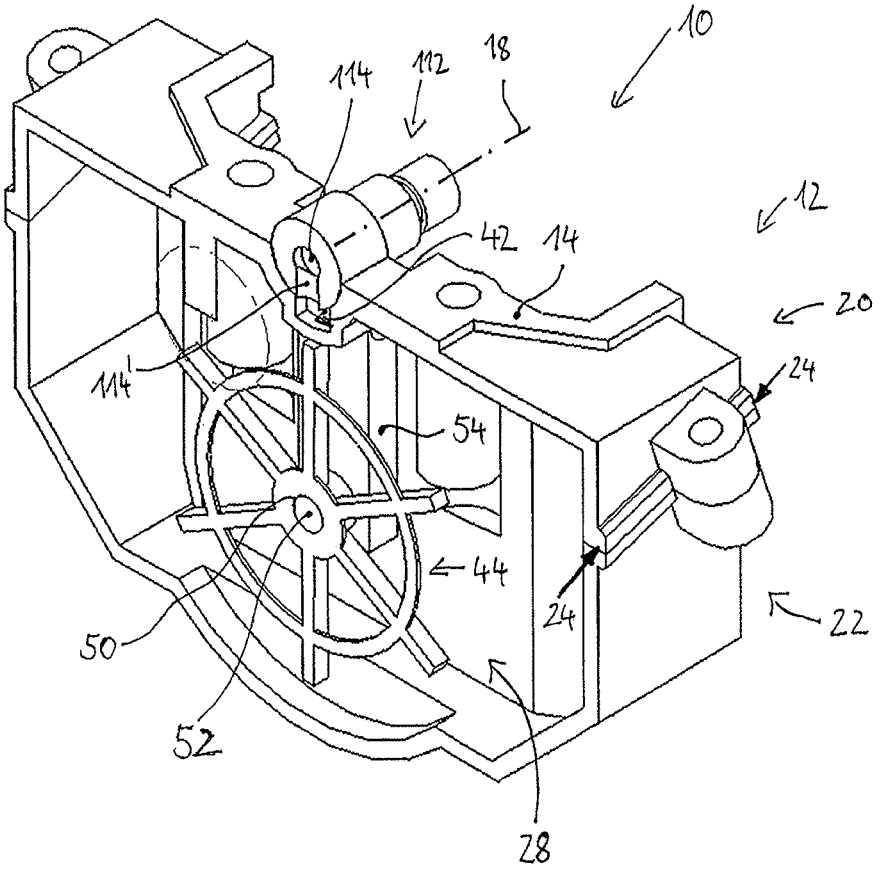
FIG. 5 is a perspective sectional view through a first portion of the first working chamber, together with the crankshaft, along a section line A-A shown in FIG. 2.
Figure 6:
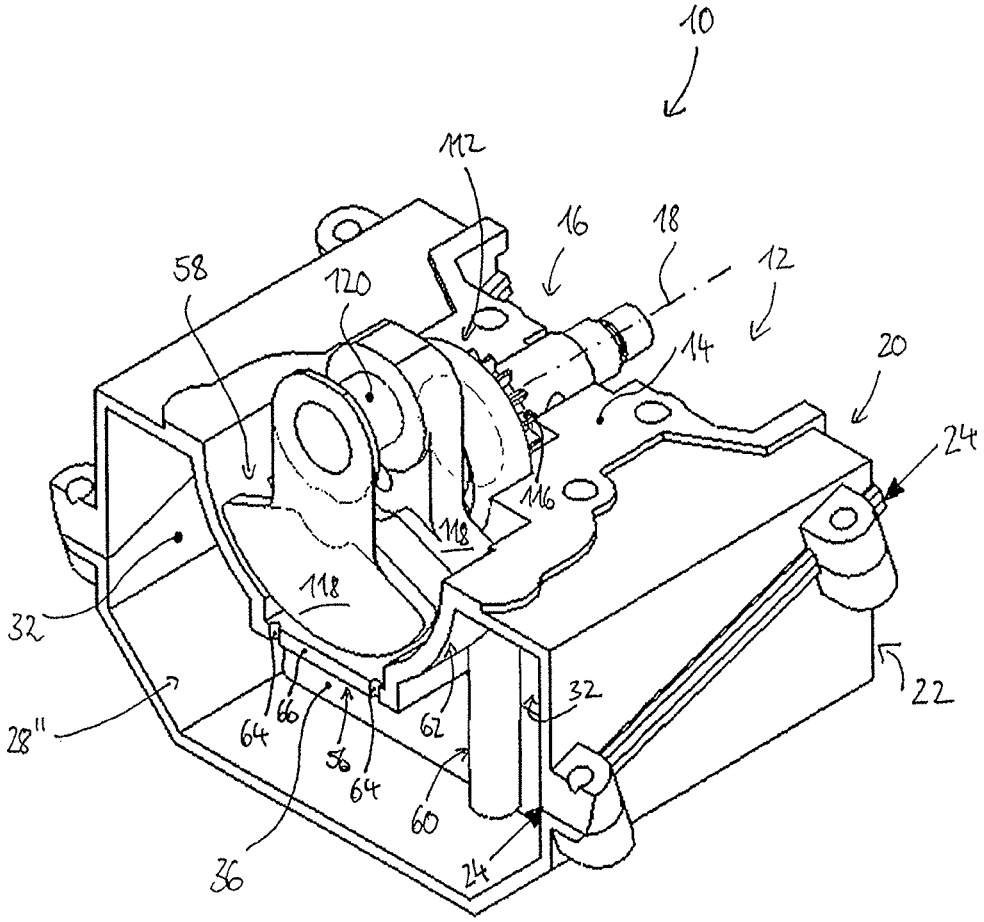
FIG. 6 is a perspective sectional view through a second portion of the first working chamber, together with the crankshaft, along a section line D-D shown in FIG. 2.

The spinner wheel 44, the toothed wheel 46 and the shaft portion 48 are integrally formed (spinner wheel and toothed wheel unit). A bearing passage 50 is provided into which a bearing pin 52 can be inserted (see FIG. 5), such that the spinner wheel 44 and the toothed wheel 46 can be mounted, namely on bearing portions 54 of the first housing portion 20 (see FIG. 2).

Figure 7:
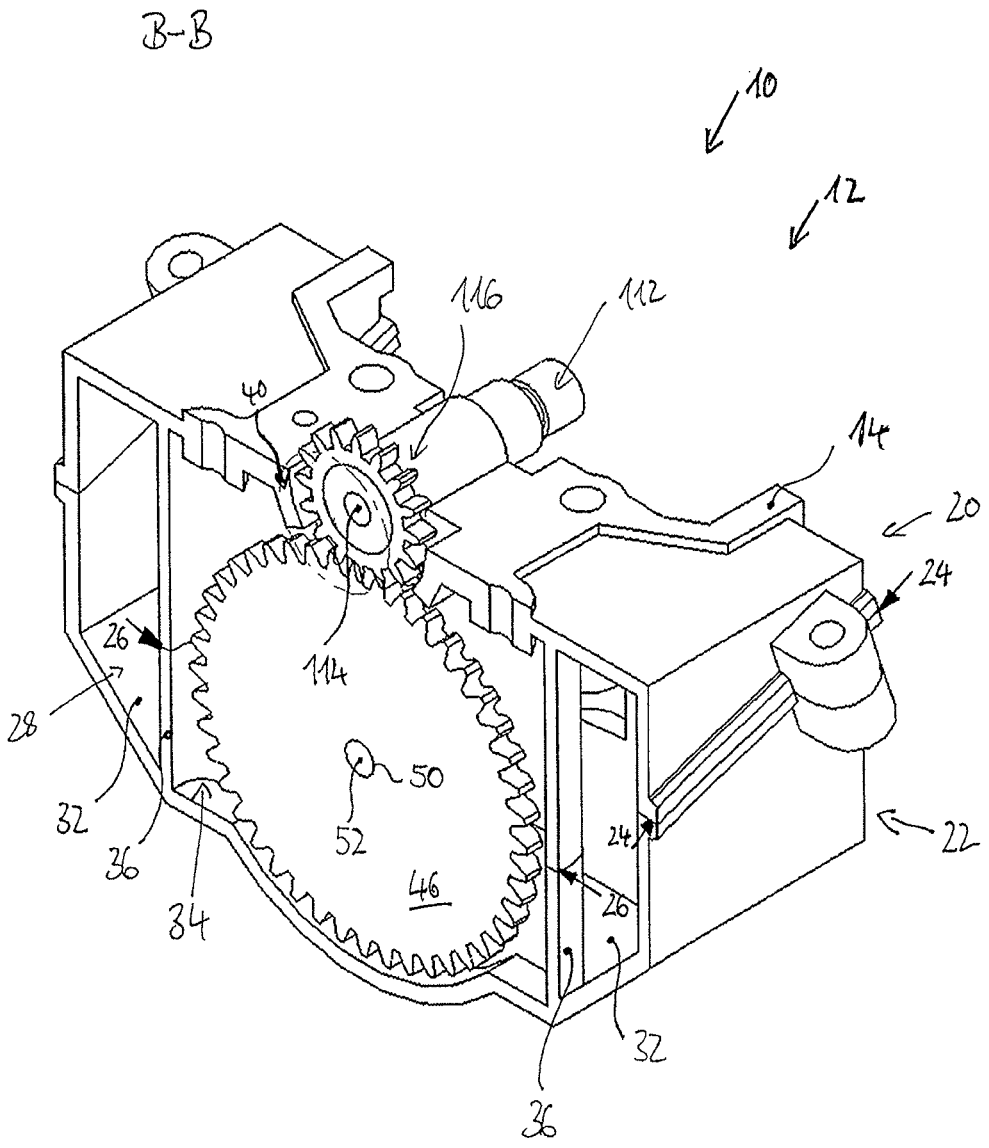
FIG. 7 is a perspective sectional view through the second working chamber, together with the crankshaft, along a section line B-B shown in FIG. 2.

The toothed wheel 46 extends to the opening 40 and meshes with a toothed wheel 116 that is arranged on the crankshaft 112 (see FIG. 7), so that when the crankshaft 112 rotates, the toothed wheel 46 and the spinner wheel 44 are also driven.

A crankcase wall 56 is provided that separates a crankcase 58 for receiving crank webs 118 of the crankshaft 112, which crankcase forms a portion of the crankshaft receiving area 16, from a second portion 28" of the first working chamber 28. The first portion 28' of the first working chamber 28 and the second working chamber 34 are, apart from the opening 40, closed by wall portions 57 towards the crankshaft receiving area 16.

A lubricant channel 60 is provided that extends, starting from the first working chamber 28, from below a lubricant fill level 39 through the crankcase wall 56 and opens into the crankcase 58. The lubricant channel 60 forms a second suction point. The lubricant channel 60 opens into a curved portion 62 of the crankcase wall 56, past which portion the crank webs 118 of the crankshaft 112 travel, so that the mouth 60' on the crankcase side is occasionally opened and occasionally restricted or closed by the crank webs 118 (see FIGS. 3 and 4).

Figure 9:
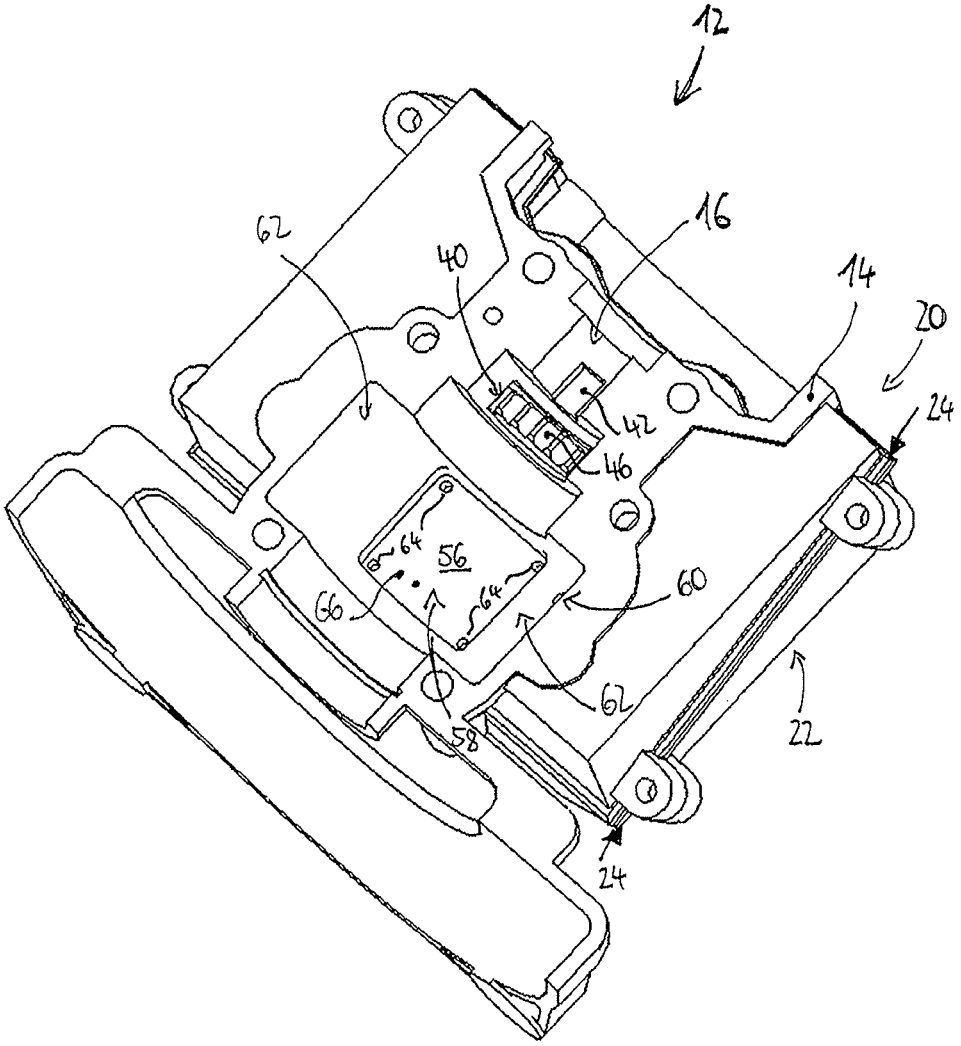
FIG. 9 is a perspective top view of the first (upper) portion of the housing of the lubricating device from FIG. 1.

Return channels 64 from the crankcase 58 into the first working chamber 28 are provided in the crankcase wall 56 (see FIG. 3 and FIG. 9). The return channels 64 may be formed as four holes that are arranged in a lower portion 66 of the crankcase 58. The crankcase wall 56 may be flat in the lower portion 66 and recessed relative to the curved portion 62, so that a collecting region for condensed lubricant 30 is formed.

The lubricating device 10 functions as follows, operation in the normal state (housing 12 oriented "downwards" in the direction of gravity) being described:

The first working chamber 28 is used to store lubricant 30 (oil reservoir), which may be engine oil 30. As soon as the internal combustion engine 100 runs and rotates the crankshaft 112, the toothed wheel 46, and therefore the spinner wheel 44, is driven by means of the toothed wheel 116 on the crankshaft 112.

By driving the spinner wheel 44, the engine oil 30 is spun, so that an oil mist 68 is produced in the first working chamber 28, which oil mist can enter the second working chamber 34 via the passage 38 (see FIG. 1).

If the piston of the internal combustion engine 100 (not shown) moves from bottom dead center (UT) to top dead center (OT), overpressure is produced in the crankcase 58 and in the crankshaft receiving area 16 due to the upward movement of the piston. As soon as and while the radial portion 114' and the recess 42 are aligned with one another, the oil mist 68 is sucked through the crankshaft lubricant hole 114 into the crankcase 58 from the second working chamber 34 via the opening 40 and the recess 42, so that the oil mist 68 can have a lubricating effect in the crankcase, e.g. in order to lubricate the connecting rod bearing (not shown) arranged on the connecting rod receiving portion 120.

If the crank webs 118 are not upstream of the mouth 60' of the lubricant channel 60 when the piston moves upwards, engine oil 30 is drawn out of the first working chamber 28 through the lubricant channel 60. The engine oil 30 enters the piston chamber 58 and can also have a lubricating effect there.

If the piston of the internal combustion engine 100 (not shown) moves from top dead center (OT) to bottom dead center (OT), overpressure is produced in the crankcase 58 and in the crankshaft receiving area 16 due to the downward movement of the piston. The radial portion 114' of the crankshaft lubricant hole 114 and the recess 42 are aligned with one another only shortly before or as soon as the piston reaches UT. When the piston moves downwards, the radial portion 114' and the recess 42 are not aligned, and therefore the overpressure in the crankcase 58 practically does not act on the crankshaft lubricant hole 114. Due to the overpressure in the crankcase 58 and optionally due to the effect of gravity, engine oil 30, which is condensed in the crankcase 58, is conveyed through the return channels 64 into the first working chamber 28. Engine oil that has a lubricating effect is therefore returned into the first working chamber 28. Circulating lubrication is implemented.

Even during operation in an inverted position (housing 12 is oriented "upwards" in the direction of gravity), the lubricating device 10 can ensure lubrication of the internal combustion engine 100. In an inverted position, the engine oil 30 in the first working chamber 28 runs towards the first (upper) housing portion 20. As in the normal position, the engine oil 30 is spun by the spinner wheel 44 in the first working chamber 28, so that oil mist 68 is produced in the first working chamber 28. The oil mist 68 can also enter the second working chamber 34 through the passage 38 in an inverted position. If the radial portion 114' of the crankshaft lubricant hole 114 is aligned with the recess 42, the oil mist 68 can be drawn when the piston moves upwards (from UT to OT) due to the overpressure in the crankcase 58, so that said oil mist can be used for lubrication e.g. on the connecting bearing receiving portion 120.

The engine oil 30 in the crankcase 58 can be used directly for lubricating the engine components. In addition, the engine oil 30, which has collected on the crankcase wall 56, enters the crankcase 58 through the return channels 64 due to the overpressure in the crankcase 58, therefore ensuring that engine oil 30 is supplied here, too.

If the piston moves downwards (from OT to UT), the radial portion 114' of the crankshaft lubricant hole 114 and the recess 42 are not aligned with one another, so that the overpressure in the crankcase 58 practically does not act on the crankshaft lubricant hole 114. Due to the overpressure in the crankcase 58, engine oil is conveyed into the first working chamber 28 through the return channels 64. In an inverted position, too, circulating lubrication can be implemented at least temporarily.

What is claimed is:

1. Lubricating device for orientation-independent lubrication of an internal combustion engine, the device comprising a housing that forms a housing part of the internal combustion engine, characterized in that a first working chamber for storing lubricant and a second working chamber that is separate from the first working chamber are arranged in the housing, that a passage is formed from the first working chamber to the second working chamber, that the second working chamber comprises an opening to a crankshaft receiving area of the housing, and that the first working chamber comprises a lubricant channel to the crankshaft receiving area, wherein the opening and the lubricant channel are spaced apart from each other in a height direction such that lubricant can be supplied to the crankshaft receiving area, irrespective of orientation, at least via the opening or the lubricant channel, characterized in that a spinner wheel is arranged in the first working chamber, which spinner wheel is coupled to a toothed wheel that is arranged in the second working chamber and extends towards the opening.

2. Lubricating device according to claim 1, characterized in that return channels from the crankshaft receiving area into the first working chamber are provided such that lubricant can be returned through the return channels from the crankshaft receiving area into the first working chamber, preferably wherein the return channels altogether have a cross-sectional area that is between 25% and 95% of the cross-sectional area of the opening and of the lubricant channel.

3. Lubricating device according to claim 1, characterized in that the spinner wheel and the toothed wheel are connected by means of a shaft portion that protrudes through the passage.

4. Lubricating device according to claim 1, characterized in that a crankcase wall is provided that separates a crankcase for receiving crank webs, which crankcase forms a portion of the crankshaft receiving region, from a portion of the first working chamber.

5. Lubricating device according to claim 4, characterized in that the lubricant channel extends, starting from the first working chamber, from below a lubricant fill level through the crankcase wall and opens into the crankcase, wherein the lubricant channel is arranged such that the mouth of the lubricant channel is closed by the crank web in the event of a piston movement from top dead center (OT) to bottom dead center (UT).

6. Lubricating device according to claim 1, characterized in that the return channels are formed in the crankcase wall, wherein the return channels each are controlled by an automatic valve.

7. Lubricating device according to claim 1, characterized in that the housing comprises a first housing portion and a separate second housing portion.

8. Lubricating device according to claim 7, characterized in that the first housing portion and the second housing portion rest on each other at a first parting plane when assembled, the first parting plane and a crankcase parting plane that is in parallel with the longitudinal axis of the crankshaft receiving area including an angle.

9. Lubricating device according to claim 7, characterized in that the first housing portion and the second housing portion rest on each other at a second parting plane when assembled, wherein the second parting plane and a crankcase parting plane that is in parallel with the longitudinal axis of the crankshaft receiving area are mutually parallel.

10. Internal combustion engine, in particular for a handheld working tool, comprising a lubricating device comprising a housing that forms a housing part of the internal combustion engine, characterized in that a first working chamber for storing lubricant and a second working chamber that is separate from the first working chamber are arranged in the housing, that a passage is formed from the first working chamber to the second working chamber, that the second working chamber comprises an opening to a crankshaft receiving area of the housing, and that the first working chamber comprises a lubricant channel to the crankshaft receiving area, wherein the opening and the lubricant channel are spaced apart from each other in a height direction such that lubricant can be supplied to the crankshaft receiving area, irrespective of orientation, at least via the opening or the lubricant channel, characterized in that a spinner wheel is arranged in the first working chamber, which spinner wheel is coupled to a toothed wheel that is arranged in the second working chamber and extends towards the opening.

* * * * *